US009854345B2

(12) United States Patent
Briggs

(10) Patent No.: US 9,854,345 B2
(45) Date of Patent: Dec. 26, 2017

(54) IN-EAR HEADPHONE WITH CABLE EXIT POSITIONED FOR IMPROVED STABILITY

(71) Applicant: Bose Corporation, Framingham, MA (US)

(72) Inventor: Drew Stone Briggs, Brooklyn, NY (US)

(73) Assignee: BOSE CORPORATION, Framingham, MA (US)

( * ) Notice: Subject to any disclaimer, the term of this patent is extended or adjusted under 35 U.S.C. 154(b) by 352 days.

(21) Appl. No.: 14/294,694

(22) Filed: Jun. 3, 2014

(65) Prior Publication Data

US 2015/0350764 A1 Dec. 3, 2015

(51) Int. Cl.
*H04R 25/00* (2006.01)
*H04R 1/10* (2006.01)

(52) U.S. Cl.
CPC ..... *H04R 1/1033* (2013.01); *H04R 1/1016* (2013.01)

(58) Field of Classification Search
CPC ..... H04R 1/10; H04R 1/1016; H04R 1/105; H04R 1/1058; H04R 1/1066
See application file for complete search history.

(56) References Cited

U.S. PATENT DOCUMENTS 3,548,118 A * 12/1970 Hutchings ..... H04M 1/05 379/430
5,519,782 A * 5/1996 Shinohara ..... H04R 1/1016 381/370
5,659,156 A * 8/1997 Mauney ..... H04R 1/1016 181/130
5,761,298 A * 6/1998 Davis ..... H04M 1/05 379/430
5,781,638 A * 7/1998 Hosaka ..... H04R 1/1016 381/322
6,688,421 B2 * 2/2004 Dyer ..... A61F 11/08 181/130

(Continued)

FOREIGN PATENT DOCUMENTS

EP 2165563 B1 9/2013

OTHER PUBLICATIONS

International Preliminary Report on Patentability in counterpart International Patent Application No. PCT/US2015/033525, dated Dec. 15, 2016; 8 pages.

*Primary Examiner* — Duc Nguyen
*Assistant Examiner* — Taunya McCarty
(74) *Attorney, Agent, or Firm* — Schmeiser, Olsen & Watts LLP

(57) ABSTRACT

An in-ear headphone comprises an earbud body constructed and arranged for positioning at an ear of a wearer. The earbud body extends along a first axis in a first direction. A nozzle extends from the earbud body for positioning at an ear canal of the ear, and for directing an audio output at the ear canal of the ear. A cable exit interface is at an edge of the earbud body along a second axis that extends in the first direction along a region proximal to an edge of the earbud body, the second axis offset from the first axis. A cable extends from the cable exit interface at the edge of the earbud body. The cable exit interface is constructed and arranged to impart a force on the nozzle in a direction of the ear canal in response to a force imparted on the cable in a direction away from the first axis and tangential to the second axis.

17 Claims, 7 Drawing Sheets

(56) References Cited

U.S. PATENT DOCUMENTS

| | | | | |
|---|---|---|---|---|
| 6,760,459 | B2 * | 7/2004 | Bae | H04R 1/1025 379/430 |
| 7,120,268 | B2 * | 10/2006 | Murozaki | H04R 1/105 381/370 |
| 8,139,806 | B2 * | 3/2012 | Hosaka | H04R 1/1075 381/370 |
| 8,249,286 | B2 * | 8/2012 | Nault | H04R 1/1033 381/182 |
| 8,249,287 | B2 | 8/2012 | Silvestri et al. | |
| 2003/0174853 | A1 * | 9/2003 | Howes | H04R 1/083 381/370 |
| 2006/0239447 | A1 | 10/2006 | Sabick | |
| 2008/0144877 | A1 * | 6/2008 | Ham | H04R 1/105 381/379 |
| 2008/0273737 | A1 * | 11/2008 | Oosato | H04R 1/1008 381/371 |
| 2009/0285434 | A1 | 11/2009 | Williams et al. | |
| 2010/0027824 | A1 * | 2/2010 | Atamaniuk | H04M 1/05 381/322 |
| 2012/0087534 | A1 * | 4/2012 | Pelland | H04R 1/1041 381/380 |
| 2014/0211977 | A1 * | 7/2014 | Armstrong | H04R 1/105 381/380 |

* cited by examiner

IN-EAR HEADPHONE WITH CABLE EXIT POSITIONED FOR IMPROVED STABILITY

BACKGROUND

1. Field

The present disclosure relates generally to an audio device, and more specifically, to in-ear headphones.

2. Description of Related Art

A typical technique for wearing an earphone is to place the earbud in each ear, then permit a cable extending from the earbuds to drape around the nape of the neck or under the chin to an input cable coupled to an electronic device.

BRIEF SUMMARY

In one aspect, an apparatus includes an in-ear headphone, comprising an earbud body, a nozzle, a cable exit interface, and a cable. The earbud body is constructed and arranged for positioning at an ear of a wearer. The earbud body extends along a first axis in a first direction. The nozzle extends from the earbud body for positioning at an ear canal of the ear, and for directing an audio output at the ear canal of the ear. The cable exit interface is at an edge of the earbud body along a second axis that extends in the first direction along a region proximal to an edge of the earbud body. The second axis offset from the first axis. The cable extends from the cable exit interface at the edge of the earbud body. The cable exit interface is constructed and arranged to impart a force on the nozzle in a direction of the ear canal in response to a force imparted on the cable in a direction away from the first axis and tangential to the second axis.

The following are examples within the scope of this aspect.

The in-ear headphone can further comprise a housing coupled to the cable exit interface; and a plurality of electronic components positioned in the housing, wherein the force imparted on the cable in response to a movement of the cable is unrestricted by the housing.

The force imparted on the nozzle can create a torque that drives the nozzle into the ear canal to stably position the earbud body in the ear of the wearer.

The in-ear headphone can further comprise an earbud tip coupled to the nozzle, the earbud tip comprising a cone-shaped distal end for positioning at the ear canal entrance and a retaining loop for positioning along an antihelix of the ear.

The force can create a torque that drives the cone-shaped distal end of the earbud tip into the ear canal of the ear, the loop so that the loop moves in a direction along the antihelix, and the earbud tip for positioning a body of the earbud tip under the antitragus of the ear to stably position the earbud in the ear of the wearer, or a combination thereof.

The cone-shaped distal end of the earbud tip can include a sealing interface formed at the ear canal in response to the force imparted on the cable.

The force imparted on the cable in the direction tangential to the second axis can include a force applied in a direction of a nape of a neck.

The in-ear headphone can further comprise a path extending from the cable exit along the second axis, wherein the cable extends in a direction tangential to the path in response to the force applied to the cable.

In another aspect, an in-ear headphone comprises an earbud body, an earbud tip, a cable exit interface, and a cable. The earbud body is constructed and arranged for positioning in an ear of a wearer, the earbud body positioned along a first axis extending in a first direction. The earbud tip is coupled to the earbud body. The earbud tip comprises a cone-shaped distal end for positioning in an ear canal. The cable exit interface is at an edge of the earbud body along a second axis that extends in the first direction along a region proximal to an edge of the earbud body. The second axis is offset from the first axis. The cable extends from the cable exit interface at the edge of the earbud body. The cable exit interface is constructed and arranged to lock the earbud tip in the ear canal in response to a force imparted on the cable.

The following are examples within the scope of this aspect.

The cable exit interface can lock the earbud tip in the ear canal by imparting a force on the earbud tip in a direction of the ear canal in response to the force imparted on the cable in a direction away from the first axis and tangential to the second axis.

The force imparted on the earbud tip can create a torque that drives the cone-shaped distal end of the earbud tip into the ear canal of the ear.

The earbud tip can further comprise a retaining loop for positioning along an antihelix of the ear.

The cable exit interface can lock the earbud tip in the ear canal including imparting a torque that drives the cone-shaped distal end of the earbud tip into the ear canal of the ear, the loop so that the loop moves in a direction along the antihelix, and the earbud tip for positioning the earbud tip at the antitragus of the ear to stably position the earbud body in the ear of the wearer, or a combination thereof.

The cable exit interface can be constructed and arranged to unlock the earbud tip from the ear canal by imparting a torque on the earbud tip that separates the cone-shaped distal end of the earbud tip from the ear canal.

The cone-shaped distal end of the earbud tip can include a sealing interface formed at the ear canal in response to the force imparted on the cable.

The force imparted on the cable in the direction tangential to the second axis can include a force applied in a direction of a nape of a neck.

In another aspect, a method for positioning and retaining a headphone in an ear, comprises inserting at least a portion of a nozzle of an earbud of the headphone at an ear canal at the ear; positioning the earbud body along a first axis extending in a first direction; positioning a cable from an cable exit interface at an edge of the earbud body along a second axis in the first direction, the second axis offset from the first axis; imparting a force on the cable in a direction away from the first axis and tangential to the second axis; and imparting a force on the nozzle in a direction of the ear canal in response to the force imparted on the cable extending from the cable exit interface at the edge of the earbud body.

The following are examples within the scope of this aspect.

The method can comprise coupling an earbud tip at the nozzle of the earbud body, the earbud tip comprising a retaining loop; and in response to imparting the force on the cable, impart a torque that drives a distal end of the earbud tip into the ear canal of the ear, the loop so that the loop moves in a direction along an antihelix of the ear, and the earbud tip for positioning the earbud tip at an antitragus of the ear to stably position.

The method can further comprise forming a sealing interface at the ear canal in response to the force imparted on the cable.

Imparting the force on the cable in the direction tangential to the second axis can include applying a force in a direction of a nape of a neck.

Other aspects and features and combinations of them can be expressed as methods, apparatus, systems, program products, means for performing functions, and in other ways.

BRIEF DESCRIPTION

The above and further features and advantages may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

A conventional earphone, when worn, is prone to forces that may impact the stability of the earphone, for example, causing the earphone to become dislodged from the ear canal. Stability reduction may be exacerbated by the manner in which the connecting cable is positioned, for example, draping the connecting cable behind the neck. It is therefore desirable to provide headphones, in particular, in-ear headphones, or earphones, that address and overcome such shortcomings related to earphone stability.

Figure 1:
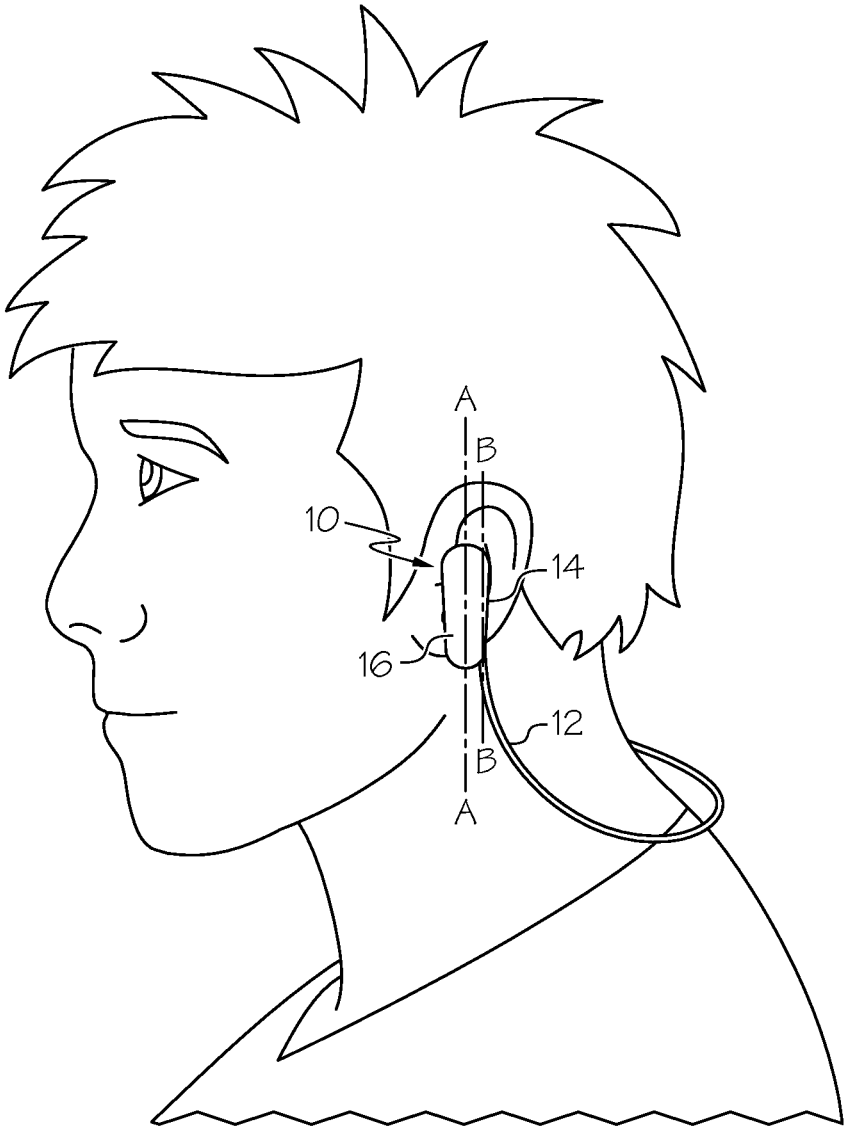
FIG. 1 is a view of a headphone positioned in an ear, in accordance with some examples.

FIG. 1 is a view of an in-ear headphone 10 positioned in an ear, in accordance with some examples. The headphone 10 can be an earbud or other in-ear style earphone, which represents one type of headphone. However, the present inventive concepts are not limited to the example of the headphone 10 shown in FIG. 1. Accordingly, other headphone types can equally apply. The headphone 10 is constructed and arranged for positioning in a left ear, but can alternatively or in addition be constructed and arranged for positioning in a right ear, for example, shown in other figures herein.

The headphone 10 can be centered along an axis A. A cable exit 14 is positioned at a region at or proximal the headphone body 16 that extends along an axis B that is offset, or parallel, to axis A. A cable 12 is constructed and arranged to extend from the cable exit 14. The cable 12 can be constructed and arranged to exchange electrical signals, for example, acoustic data, between a sound system or second headphone (not shown) at one end of the cable to the headphone 10 at the other end of the cable, for example, at the cable exit 14.

The location of cable exit 14 along axis B permits forces imparted on an earbud (not shown in FIG. 1) of the headphone 10 to be managed and distributed in a manner that provides stability to the headphone 10 when positioned in the ear of a wearer, for example, when the cable 12 extends from the cable exit 14 of the headphone 10 to a nape of the neck of the wearer as shown in FIG. 1. The location of the cable exit 14 at the back edge of the earbud translates to a distribution of forces imparted on various elements of the headphone 10 (described below) that maintain a position of the earphone in the ear even during movement of the wearer, thereby reducing frustration and/or discomfort accompanying an earbud seated in an unstable manner in the ear. For example, movement or vibration may cause existing earbuds to eject. The headphone 10 is constructed and arranged to apply these forces that would otherwise eject the earbud so that the forces instead improve stability and, in relevant applications, improve a seal on ear canal.

Figure 2:
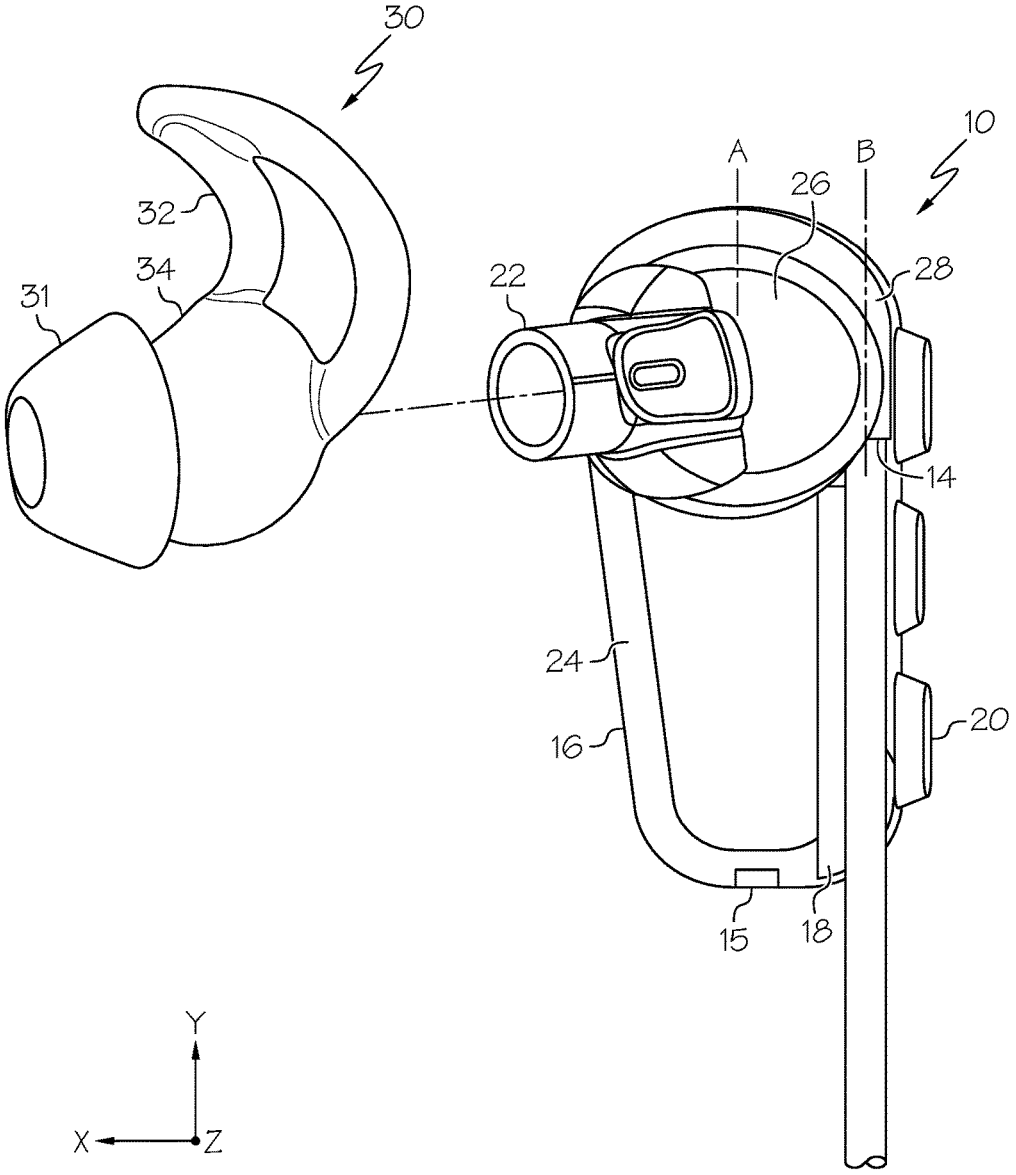
FIG. 2 is an external perspective view of a headphone, in accordance with some examples.
Figure 3:
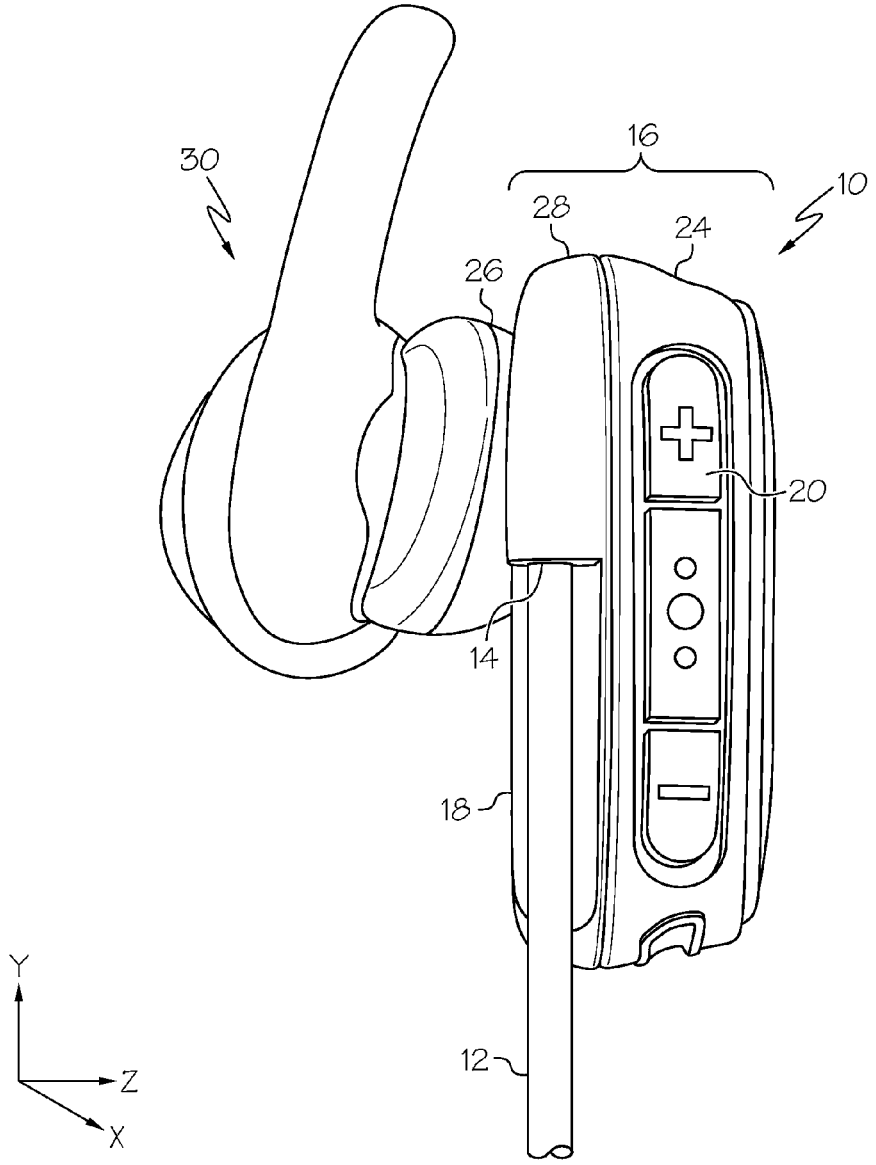
FIG. 3 is a back view of the headphone of FIG. 2.

FIG. 2 is an external perspective view of a headphone 10, in accordance with some examples. FIG. 3 is a back view of the headphone 10 of FIG. 2. The headphone 10 can be the same or similar to that shown and described with respect to FIG. 1. The headphone 10 of FIGS. 2 and 3 is illustrated as constructed and arranged for positioning in a right ear, but can alternatively or in addition be constructed and arranged for positioning in a left ear, for example, shown in FIG. 1.

The earbud 26 of the headphone 10 can be coupled to an optional headphone body 16. Alternatively, the earbud 26 and the optional body 16 can be formed of a same material, for example, molded from a common plastic.

The headphone body 16 includes a cable exit interface 28 coupled to the earbud 26, or extending from the earbud 26, for example, molded of a common material. The various components may be formed of the same material or different materials, and may be molded together or assembled. For example, an optional electronics housing 24 of the headphone body 16 can be coupled to the cable exit interface 28, or otherwise molded of a common material as the cable exit interface 28 and/or the earbud 26.

The cable exit interface 28 includes the cable exit 14 from which the cable 12 extends. The cable exit interface 28 can also include a path 18, such as a groove or the like, along which the cable 12 can extend when no force, or a gravity-related force, is present at the cable 12. A force can be applied to the cable 12 in a direction tangential to the path 18, and away from the housing 24. The cable exit interface 28 and optional path 18 are constructed and arranged to prevent the cable 12 extending form the cable exit interface 28 from making contact with or otherwise interfering with electronics housing 24 or the like when the headphone 10 is worn.

The electronics housing 24 can be configured for coupling to the cable exit interface 28. The electronics housing 24 can include circuits that permit the headphone 10 to operate, for example, electronics circuits for processing sound. The housing 24 can include a microphone opening for communicating with microphone-related circuits in the housing 24. The housing 24 can include a connector 15 at a distal end of the electronics housing 24. The connector 15 can include a port, socket, or the like for coupling with an electronic device, for example, a micro Universal Serial Bus (USB) device or the like, to provide power and/or data to the headphone 10. The housing 24 can include one or more circuit interfaces 20 such as buttons, switches, and so on, for controlling various circuits in the electronic housing 24, cable exit interface, and/or earbud 26, for example, adjusting a speaker volume.

The earbud 26 can include an acoustic driver or transducer such as a speaker, which is positioned in an earbud housing constructed and arranged for positioning in an ear, more specifically, a region of the ear proximal the ear canal. The earbud 26 includes a nozzle 22 that has an opening so that sound-related signals produced at the speaker can be output from the nozzle 22 via the opening. The nozzle 22 is at a different location of the earbud 26 than the cable exit interface 28, for example, the nozzle 22 and the cable exit interface 28 are at opposite sides of a center of rotation at the earbud 26. The nozzle 22 and the cable exit interface 28 are constructed and arranged for positioning at the earbud 26 relative to each other so that a force is imparted on the nozzle 22 to "lock" the nozzle 22, and/or an earbud tip 30 coupled to the nozzle, at the ear canal when a force is imparted on the cable 12 extending from the cable exit interface 28. For example, the draping of the cable 12 is driven by gravity. The back of the neck where the positioning of the earbud 26, nozzle 22, and/or earbud tip 30, is driven by internal ear features. For example, the cable exit interface 28 and cable 12 can extend along the B-axis, or Y-axis shown in the key. Here, the nozzle 22 can be constructed and arranged to be tangential to the x-z plane to achieve the foregoing.

The earbud tip 30 includes a tip body 34 that can be positioned over the nozzle 22. A distal end 31 of the tip body 34 is configured to fit inside a region of the ear proximal the ear canal, for example, cone-shaped. The tip body 34 can comprise a material that is flexible, compressible, and/or elastomeric, so that the earbud tip 30 can conform to the ear when pressed into the ear canal by a force (described below). The distal end 31 of the tip body 34 includes an opening that can be aligned with the nozzle opening so that sound generated by a speaker or the like in the earbud 26 can be output via the nozzle 22 and the tip body opening 31 to the ear canal.

The tip 30 includes a retaining loop 32 that is constructed and arranged for positioning along the antihelix of the ear, and for providing a pivot point with respect to the earbud tip 30 and earbud 26, so that the loop 32, earbud tip 30, and earbud 26 each rotate relative to the pivot point when one or more forces are applied to the headphone 10. See U.S. Pat. No. 8,249,287, and U.S. Patent Publication No. 2013/0230204, both incorporated here by reference.

Figure 4:
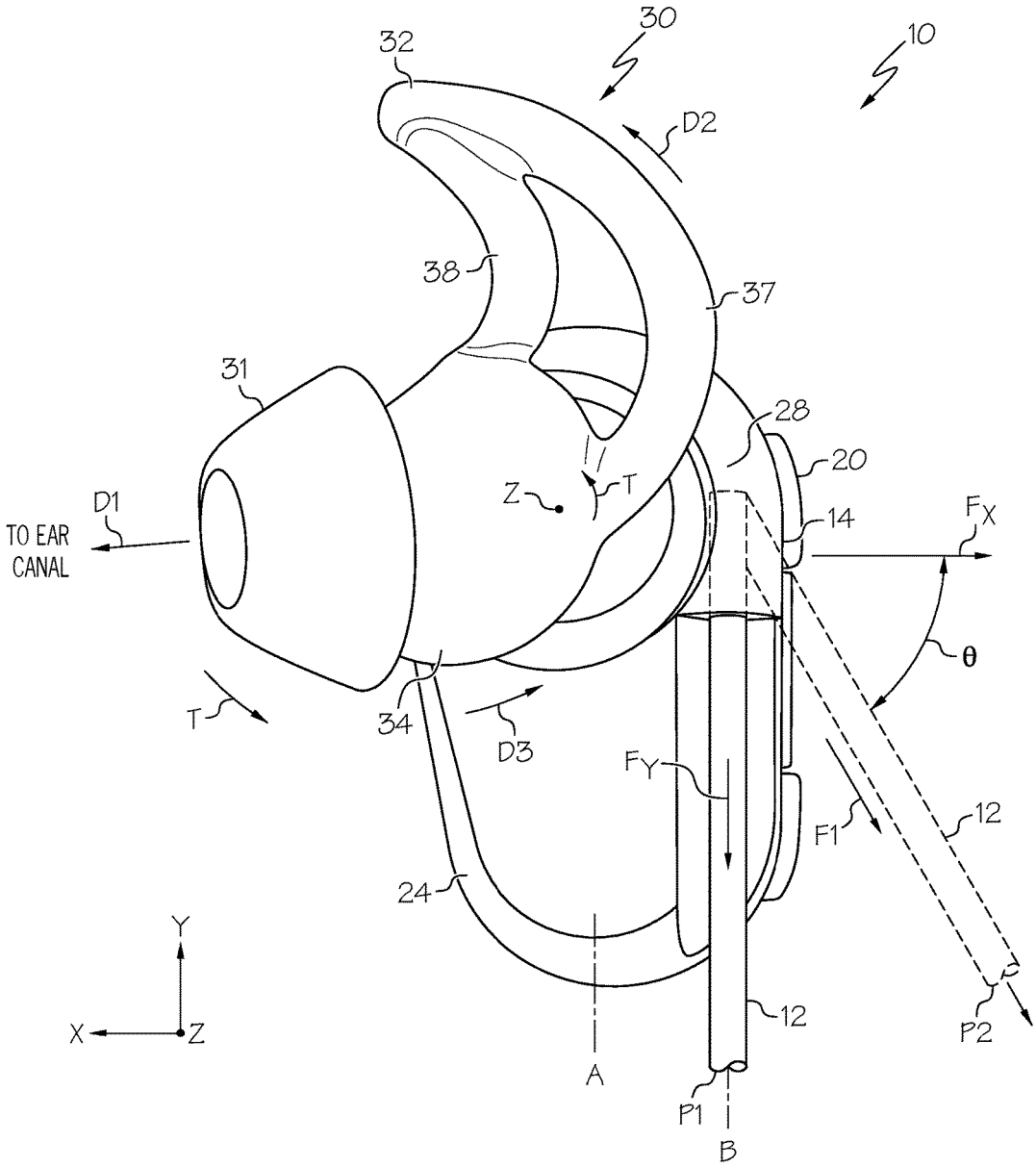
FIG. 4 is another perspective view of the headphone of FIGS. 2 and 3, and an illustration of forces applied to the headphone when the headphone is positioned at an ear, in accordance with some examples.
Figure 5:
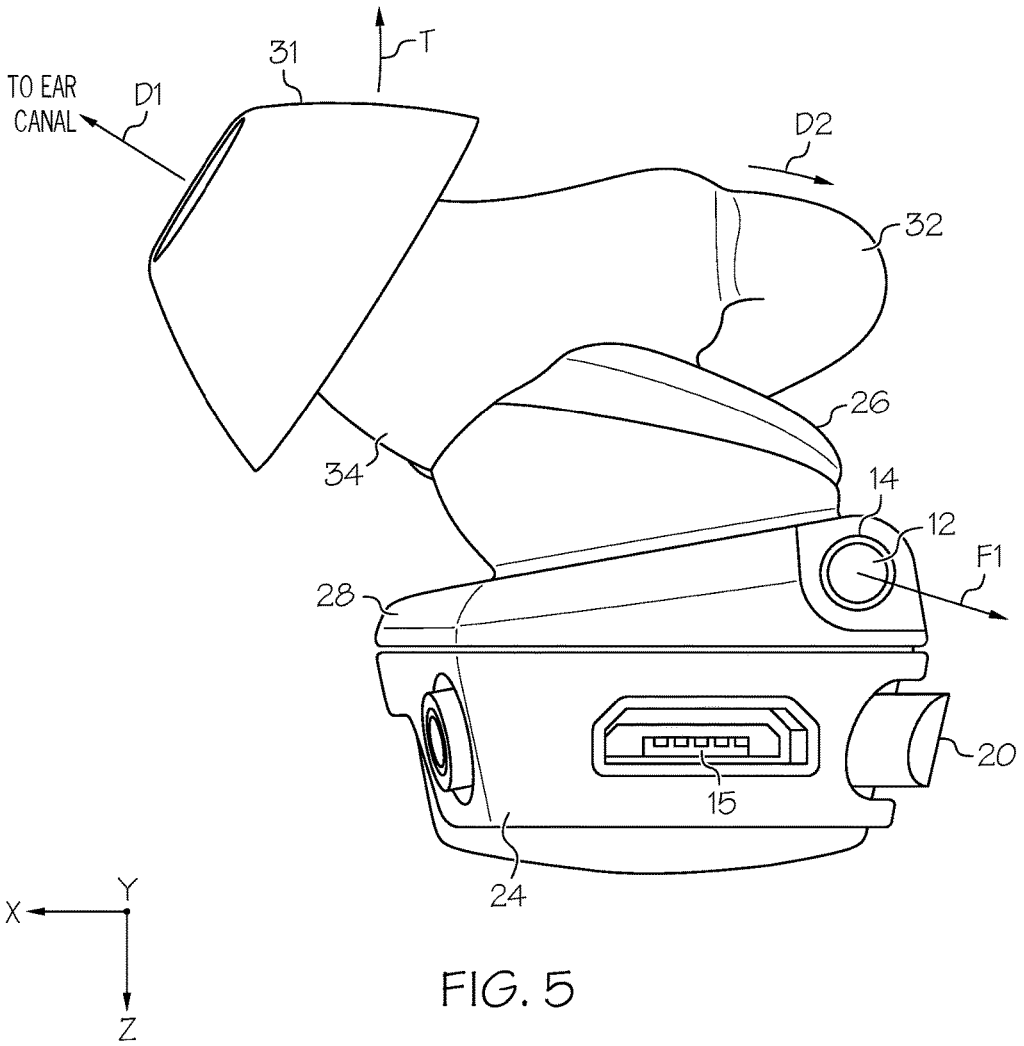
FIG. 5 is a bottom view of the headphone of FIGS. 2-4, and an illustration of forces applied to the headphone when the headphone is positioned at an ear, in accordance with some examples.
Figure 6:
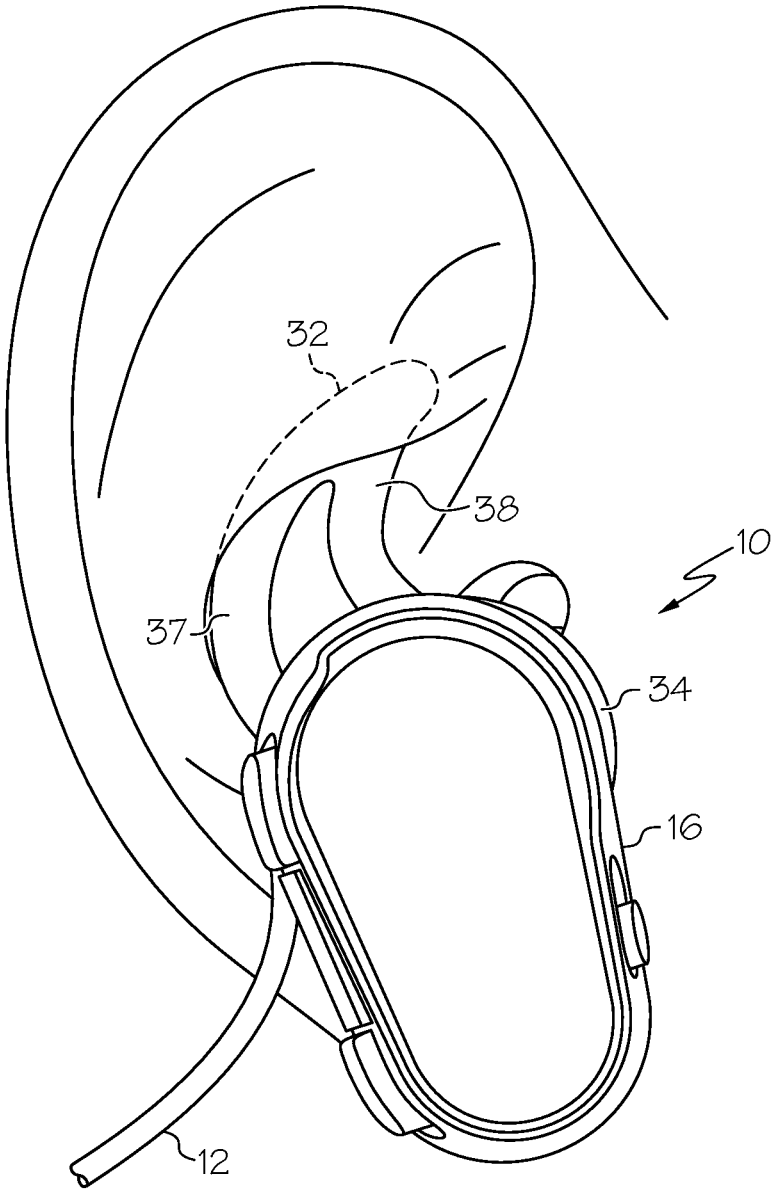
FIG. 6 is a view of the headphone of FIGS. 2-5 positioned in a human ear, in accordance with some examples.

FIG. 4 is another perspective view of the headphone 10 of FIGS. 2 and 3, and an illustration of forces applied to the headphone 10 when the headphone 10 is positioned at an ear, in accordance with some examples. FIG. 5 is a bottom view of the headphone 10 of FIGS. 2-4, and an illustration of forces applied to the headphone 10 when the headphone 10 is positioned at the ear, in accordance with some examples. FIG. 6 is a view of the headphone of FIGS. 2-5 positioned in a human ear, in accordance with some examples.

A force is applied to the headphone 10 when the headphone cable 12 transitions from a first position P1 to a second position P2, in accordance with some examples. The first position P1 of the headphone cable 12 can be a position of the headphone 10 when the earbud tip 30 is initially inserted in an ear (not shown). The second position P2 of the headphone 10 can be referred to as a "locked position," whereby the cable 12 is draped over the neck or shoulder, and one or more forces is applied to different elements of the headphone 10 to stabilize the headphone 10 in the ear.

As described above, the cable exit 14 is positioned at a region of the cable exit interface 28 adjacent a back edge of the earbud 26, and is therefore off-center with respect to the earbud 26. Here, the cable exit interface 28 can distribute forces for seating the earbud 26 and/or earbud tip 30 in the ear in the locked position P2. Accordingly, a movement of the cable 12 extending from the cable exit 14 is not impeded by the earbud 26 or headphone body 16.

At the first position P1, the cable 12 can extend from the cable exit 14 in a first direction, for example, along axis B in a vertical or near vertical direction, and parallel or near parallel to a central axis A along which the earbud 26 and/or headphone body 16 extends. At the second position P2, the cable extends in a second direction that is tangential with respect to the first direction.

The cable 12 can be subject to a first force F1 comprising a horizontal component Fx and a vertical component Fy. When the cable 12 is in the second position P2, for example, draped about a back of a neck, the first force F1 acts at an angle θ from the x-axis. For example, the cable 12 is pulled back and down toward the back of the neck (not shown).

In response to the first force F1 exerted on the cable in this manner, a torque T can be imparted at the earbud 26 and/or optional earbud tip 30. More specifically, after the earbud 26 is positioned in an ear, the torque T can be imparted about a pivot point Z, for example, in a clockwise direction of a right earbud as viewed from the back, at which the earbud 26 is centered with respect to a headphone 10. The nozzle 22, and/or earbud tip 30 positioned over the nozzle 22, can extend from the earbud 26 along an axis that is tangential to the Z-axis (extending out of the page on which FIG. 4 is illustrated in the key) about which the rotational force rotates. The torque T can be the same torque that drives the nozzle 22 and tip body 31 in a direction D1 of the ear canal, for example, along a helical path, thereby securing the distal end 31 at the ear canal. The torque T can also be the same torque that drives the body 31 under the antitragus. In doing so, the dominant force Fy creates a torque T about the center of the earbud 26, whereby the amount of torque may depend on the distance to center axis A of the earbud 26. Accordingly, the ear canal and the notch under the antitragus form the datums for the earbud 26 and tip 30.

In addition, the retaining loop 32 rotates in a direction D2 along the antihelix of the ear to seat outer leg 37 of the retaining loop 32 beneath the antihelix, which can contribute to the distal end 31 entering the ear canal. Also, the tip body 34 moves in a direction D3, whereby a torque is applied, which places at least a portion of the tip body 34 and/or outer leg 37 in the locking position under the antitragus of the ear. The inner leg 38 of the loop 32 can apply a force at the top of the antihelix, so that the loop 32 locks under the antihelix. The loop 32 is flexible and can move in and out of plane and curl up to fit multiple ear internal sizes.

Thus, during operation of the headphone 10, the headphone 10 can be stably positioned in the ear, which is beneficial during activities such as sporting events where the user's body experiences small motions. Such motions can maintain the earbud tip 30 against the ear canal entrance, since the cable is angled in a manner, even during such body motion, that imparts a force on the earbud 26 toward the ear canal.

In addition, as the earbud tip 30 is urged into the ear canal in response to the abovementioned forces, the compliant material forming the earbud tip 30, or a nozzle having a compliant configuration in the absence of an earbud tip, can provide a sealing interface, or seal or plug, with respect to the ear canal entrance, providing further stable positioning of the headphone 10 at the ear.

The headphone 10 can be removed in the ear, for example, by ejecting the earbud 26 from the ear in response to pulling the cable 12 in the opposite direction. This can be achieved, in some examples, by reversing the direction of one or more forces described in FIG. 4, for example, applying a torque T in the opposite direction, whereby the nozzle 22 moves in an opposite direction as direction D1, i.e., in a direction away from the ear canal, for example, along a helical path, thereby separating the distal end 31 of the earbud tip 30 from the ear canal.

Figure 7:
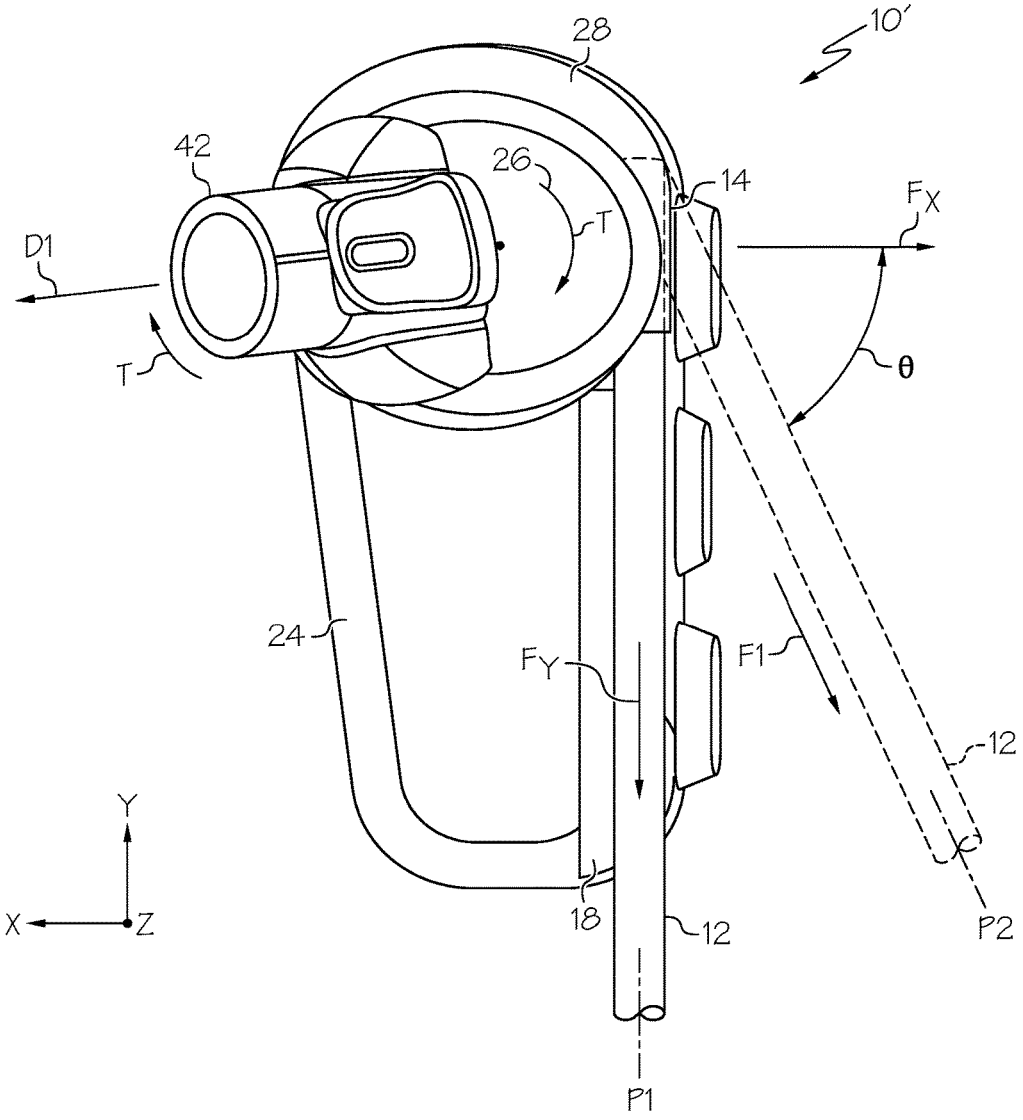
FIG. 7 is a perspective view of a headphone, and an illustration of forces applied to the headphone when the headphone is positioned at an ear, in accordance with other examples.

FIG. 7 is another perspective view of a headphone 10', and an illustration of forces applied to the headphone 10' when the headphone 10' is positioned at an ear, in accordance with other examples. The headphone 10' can be similar to the headphone 10 described at FIGS. 2-6, except that the headphone 10' does not include an earbud tip. Instead, headphone 10' includes a nozzle 42 that is positioned in the ear canal of a human ear. The nozzle 42 can have a similar or different configuration than the nozzle 22 of the headphone 10, over which an earbud tip 30 is positioned. For example, the nozzle 42 can be formed of a compliant material, providing for a compressible surface that compliantly conforms to the ear canal surface when the headphone 10' is positioned in the ear canal, and the cable 12 is articulated in a position that imparts one or more forces described herein.

The cable exit 14 is positioned at a region of the cable exit interface 28 adjacent a back edge of the earbud 26, and is therefore off-center with respect to the earbud 26. Here, the cable exit interface interface 28 can distribute forces for seating the earbud 26 and/or nozzle 42 in the ear in the locked position P2.

One or more forces are applied to the headphone 10' when the headphone cable 12 transitions from a first position P1 to a second position P2, in accordance with some examples. At the second position P2, one or more forces is applied to different elements of the headphone 10 to stabilize the headphone 10 in the ear.

At the first position P1, the cable 12 can extend from the cable exit 14 in a first direction, for example, in a vertical or near vertical direction, and parallel or near parallel to a central axis along which the earbud 26 and/or headphone body 16 extends. At the second position P2, the cable extends in a second direction that is tangential with respect to the first direction.

The cable 12 can be subject to a first force F1 comprising a horizontal component Fx and a vertical component Fy. When the cable 12 is in the second position P2, for example, draped about a back of a neck, the first force F1 acts at an angle θ from the x-axis. For example, the cable 12 is pulled back and down toward the back of the neck (not shown).

In response to the first force F1 exerted on the cable in this manner, a torque T can be imparted at the earbud 26. More specifically, after the earbud 26 is positioned in an ear, a torque T can be imparted about a pivot point Z, for example, in a clockwise direction, at which the earbud 26 is centered with respect to a headphone 10. The nozzle 22 can extend from the earbud 26 along an axis that is tangential to the Z-axis (extending out of the page on which FIG. 7 is illustrated) about which the torque T rotates. The imparted torque T can drive the nozzle 42 in a direction D1 of the ear canal, for example, along a helical path, thereby securing the nozzle 42 at the ear canal.

A number of implementations have been described. Nevertheless, it will be understood that the foregoing description is intended to illustrate and not to limit the scope which is defined by the claims.

What is claimed is:

1. An in-ear headphone, comprising:

an earbud body constructed and arranged for positioning at an ear of a wearer, the earbud body extending along a first axis in a first direction;

a nozzle extending from the earbud body for positioning at an ear canal of the ear, and for directing an audio output at the ear canal of the ear;

a cable exit interface at an edge of the earbud body and along a second axis that extends in the first direction along a region proximal to an edge of the earbud body, the second axis offset from and parallel to the first axis; and a cable extending from the cable exit interface at the edge of the earbud body, wherein the cable exit interface is constructed and arranged to apply a rotational torque to the nozzle along at least a portion of a helical path in a direction towards the ear canal in response to a force applied to the cable in a direction away from the first axis and the earbud body and in a direction towards a back of a neck of the wearer.

2. The in-ear headphone of claim 1, further comprising:

a housing coupled to the cable exit interface; and a plurality of electronic components positioned in the housing, wherein the force applied to the cable in response to a movement of the cable is unrestricted by the housing.

3. The in-ear headphone of claim 1, wherein the rotational torque applied to the nozzle creates a torque that drives the nozzle into at least an entrance of the ear canal to stably position the earbud body in the ear of the wearer.

4. The in-ear headphone of claim 1, further comprising an earbud tip coupled to the nozzle, the earbud tip comprising a cone-shaped distal end for positioning at least at the ear canal entrance and a retaining loop for positioning along an antihelix of the ear.

5. The in-ear headphone of claim 4, wherein the force applied to the cable creates a torque that drives the cone-shaped distal end of the earbud tip towards the ear canal of the ear, the loop so that the loop moves in a direction along the antihelix, and the earbud tip for positioning a body of the earbud tip under the antitragus of the ear to stably position the earbud in the ear of the wearer, or a combination thereof.

6. The in-ear headphone of claim 4, wherein the cone-shaped distal end of the earbud tip includes a sealing interface formed at the ear canal entrance in response to the force applied to the cable.

7. The in-ear headphone of claim 1, further comprising a path extending from the cable exit interface along the second axis, wherein the cable extends in a direction tangential to the path in response to the force applied to the cable.

8. An in-ear headphone, comprising:

an earbud body constructed and arranged for positioning in an ear of a wearer, the earbud body positioned along a first axis extending in a first direction;

an earbud tip coupled to the earbud body, the earbud tip comprising a cone-shaped distal end for positioning in at least an ear canal entrance;

a cable exit interface at an edge of the earbud body and along a second axis that extends in the first direction along a region proximal to an edge of the earbud body, the second axis offset from and parallel to the first axis; and a cable extending from the cable exit interface at the edge of the earbud body, wherein the cable exit interface is constructed and arranged to rotate the earbud tip along at least a portion of a helical path in a direction towards the ear canal to lock the earbud tip in at least the ear canal entrance in response to a force applied to the cable in a direction away from the first axis and the earbud body and in a direction towards a back of a neck of the wearer.

9. The in-ear headphone of claim 8, wherein the cable exit interface locks the earbud tip in at least the ear canal entrance by applying a force to the earbud tip in a direction of the ear canal in response to the force applied to the cable in a direction away from the first axis and tangential to the second axis.

10. The in-ear headphone of claim 8, wherein the force applied to the cable creates a torque that drives the cone-shaped distal end of the earbud tip towards the ear canal of the ear.

11. The in-ear headphone of claim 8, wherein the earbud tip further comprises a retaining loop for positioning along an antihelix of the ear.

12. The headphone of claim 11, wherein the cable exit interface locks the earbud tip in at least the ear canal entrance includes applying a torque that drives the cone-shaped distal end of the earbud tip towards the ear canal of the ear, the loop so that the loop moves in a direction along the antihelix, and the earbud tip for positioning the earbud tip at the antitragus of the ear to stably position the earbud body in the ear of the wearer, or a combination thereof.

13. The in-ear headphone of claim 8, wherein the cable exit interface is constructed and arranged to unlock the earbud tip from at least the ear canal entrance by applying a torque to the earbud tip that separates the cone-shaped distal end of the earbud tip from the ear canal.

14. The in-ear headphone of claim 8, wherein the cone-shaped distal end of the earbud tip includes a sealing interface formed at the ear canal entrance in response to the force applied to the cable.

15. A method for positioning and retaining a headphone in an ear, comprising:

inserting at least a portion of a nozzle of an earbud of the headphone at an ear canal at the ear;

positioning a body of the earbud along a first axis extending in a first direction;

positioning a cable from an cable exit interface at an edge of the earbud body and along a second axis in the first direction, the second axis offset from and parallel to the first axis;

applying a force to the cable in a direction away from the first axis and in a direction towards a back of a neck of the wearer; and in response to applying the force to the cable, applying a rotational torque to the nozzle along at least a portion of a helical path in a direction towards the ear canal.

16. The method of claim 15, further comprising:

coupling an earbud tip at the nozzle of the earbud body, the earbud tip comprising a retaining loop; and in response to applying the force on the cable, applying a torque that drives a distal end of the earbud tip into the ear canal of the ear, the loop so that the loop moves in a direction along an antihelix of the ear, and the earbud tip for positioning the earbud tip at an antitragus of the ear to stably position.

17. The method of claim 15, further comprising:

forming a sealing interface at the ear canal in response to the force applied to the cable.

* * * * *